US005797833A

United States Patent [19]

Kobayashi et al.

[11] Patent Number: 5,797,833

[45] Date of Patent: Aug. 25, 1998

[54] INFANT INCUBATOR

[75] Inventors: Shinichi Kobayashi, Tokyo; Eiji Koike, Omiya; Kazuo Matubara, Tokyo, all of Japan

[73] Assignee: Atom Medical Corporation, Tokyo, Japan

[21] Appl. No.: 835,659

[22] Filed: Apr. 9, 1997

[30] Foreign Application Priority Data

Apr. 19, 1996 [JP] Japan ..... 8-122183

[51] Int. Cl.[6] ..... A61G 11/00

[52] U.S. Cl. ..... 600/22

[58] Field of Search ..... 600/21, 22

[56] References Cited

U.S. PATENT DOCUMENTS 3,158,150 11/1964 Croasdaile ..... 600/22
4,321,913 3/1982 Maluta et al. ..... 600/22
4,936,824 6/1990 Koch et al. ..... 128/205.26 X
5,186,710 2/1993 Koch et al. ..... 600/22

FOREIGN PATENT DOCUMENTS 2-9789 U 3/1990 Japan .
2-9790 U 3/1990 Japan .

*Primary Examiner*—Jennifer Bahr
*Assistant Examiner*—Samuel Gilbert
*Attorney, Agent, or Firm*—Woodcock Washburn Kurtz Mackiewicz & Norris LLP

[57] ABSTRACT

An infant incubator has a base for supporting a premature baby; a hood mounted on the base to provide an incubation chamber isolated from the atmosphere; a plurality of partition plates disposed along the inner surface of said hood to provide a plurality of air paths against said inner surface; a fan for circulating an air through said air paths; and a heater for heating said air, characterized by an air vessel for extending a distance between an inner surface of the hood and said partition plate to cause the circulating air to reduce its velocity. The air vessel is provided between a top plate of the hood and the upper partition plate.

7 Claims, 4 Drawing Sheets

INFANT INCUBATOR

The present invention relates to an infant incubator, in which a premature baby is received in an incubation chamber under the controlled temperature and humidity.

An infant incubator is utilized to nurse a premature baby having physical weakness in an optimal environment isolated from the atmosphere. In the infant incubator, an outer air is introduced and purified through a ventilation mechanism to an incubation chamber which receives the premature baby. An inner air is circulated through the incubation chamber, with maintaining a desirable temperature, and if necessary, humidity in the incubation chamber.

The present applicant or assignee proposed infant incubators having a hood and a double wall front door with JP-Y-2-9789 and JP-Y-2-9790 both granted and issued on Mar. 12, 1990. The transparent front door is pivotally mounted on the transparent hood. The front door carries a guide plate at back side thereof to provide a rectangular pipe or double wall so that a circulating air is indirectly supplied to a premature baby in the incubation chamber. Another infant incubator having a double wall hood may be proposed to limit the heat radiation from the incubation chamber.

However, such an infant incubator is apt to remove the body temperature and moisture component from the premature baby by the convection current generated in the incubation chamber under the condition of flow rate or temperature of the air circulated therethrough. When the cooled wind from an air conditioner is contacted to a top plate of the hood, the heat exchange is provided through the top plate of the hood, and then the incubation chamber is cooled below the predetermined temperature. When the local heat exchange is achieved through the top plate of the hood, the convection current may be generated in the incubation chamber. Accordingly, when the infant incubator is disposed on the room ventilated by the air conditioner mounted on its roof or sidewall, it is necessary to consider the position of the infant incubator to be disposed.

It is an object of the present invention to provide an infant incubator in which the cooled wind from the air conditioner contacted to the top plate of the hood does not affect the temperature in the incubation chamber.

According to the present invention, an infant incubator comprises: a base for supporting a premature baby; a hood mounted on the base to provide an incubation chamber isolated from the atmosphere; a plurality of partition plates disposed along the inner surface of said hood to provide a plurality of air paths against said inner surface; a fan for circulating an air through said air paths; a heater for heating said air; and an air vessel for extending a distance between the inner surface of the hood and said partition plate to reside the circulating air or reduce its velocity.

The air vessel is provided between a top plate of the hood and the upper partition plate.

The foregoing and other objects, features and advantages of the invention will become more apparent upon a reading of the following detailed description and drawings, in which.

Figure 1:
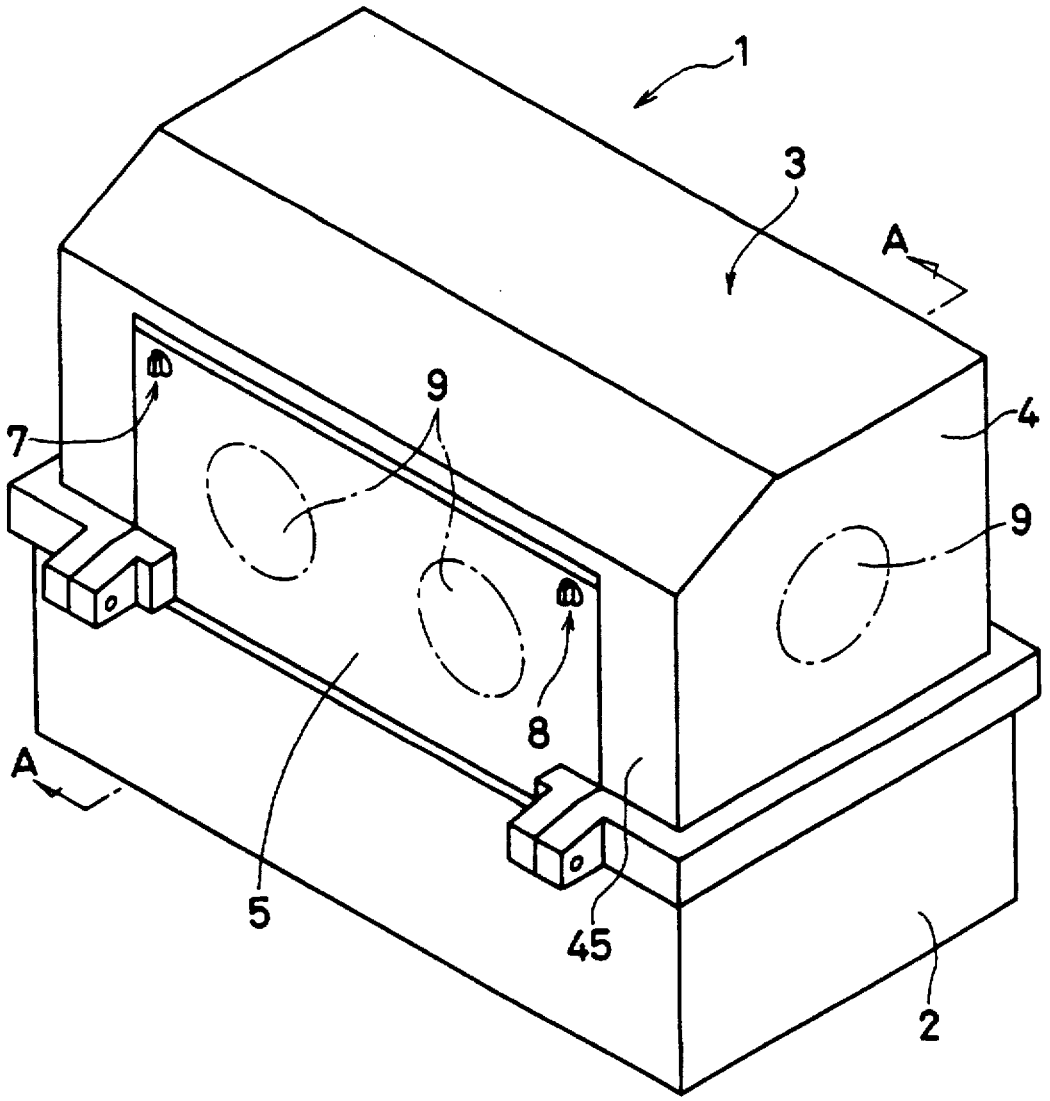
FIG. 1 shows a schematic perspective view of an embodiment of an infant incubator according to the present invention.

FIG. 1 shows a schematic perspective view of an embodiment of an infant incubator 1 according to the present invention. The infant incubator 1 is similar construction as the conventional one and comprises a base 2 having a bed 19 for receiving a premature baby. The base 2 is covered with a transparent hood 4 to provide an incubation chamber 3.

A front door 5 is pivotally mounted to a front plate 45 of the hood 4 with its lower both sides. This door 5 is in locked position as shown in FIG. 1, the locking of the door 5 is released when an upper left manual knob 7 on the door 5 is clockwise rotated and upper right manual knob 8 is anti clockwise rotated by 90 degrees, respectively to disengage a lower rim of an opening of the front plate 45. The door 5 can be opened at its upper side being pivoted to this side.

Six access ports 9 are provided on the hood 4 with 2 at front and back plates 42 and 45, respectively and 1 at right and left side plates 46, respectively. The construction of the access port 9 is similar to the conventional one and shown in phantom line. The hood 4 is made of a transparent synthetic resin such as acrylic resin so that looks of the inner side of the hood 4 is visible and monitored. The looks of the inner side are omitted to simplify the description and drawings.

Figure 2:
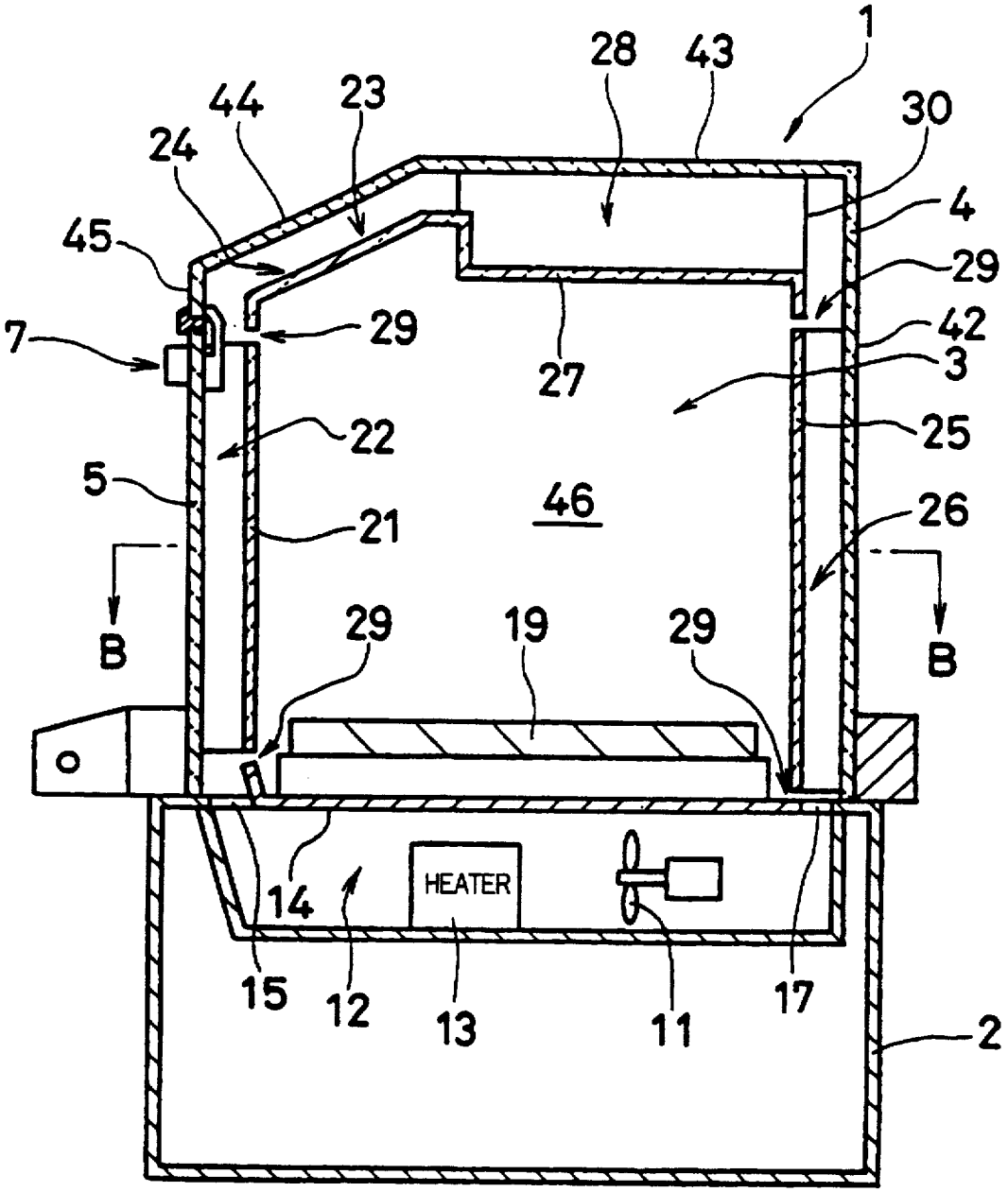
FIG. 2 shows a cross sectional view of the infant incubator taken in A—A line of FIG. 1.

FIG. 2 shows a partial cross sectional view of the infant incubator 1 taken in A—A line of FIG. 1. The hood 4 then includes a back plate 42 pivotally mounted on the base 2 at back side thereof by hinges (not shown), a top plate 43 having a gradient plate 44 and the front plate 45. These plates 42 to 45 are integral to each other and having their both side surfaces secured or adhered to side plates 46 to provide the transparent hood 4. When the food 4 covers the bed 19, the incubation chamber 3 is sealingly provided on the base 2.

Inside the base 2, a fan 11 for circulating the inner air through the incubation chamber 3 is disposed on the bottom of the duct 12. Downstream of the fan 11, a heater 13 is also provided on the bottom of the duct 12 to heat the inner air. Pluralities of output openings 15 and input openings 17 are provided with a base plate 14 of the base 2 to circulate through the incubation chamber 3 the inner air being controlled at the desirable temperature and humidity levels. The plurality of the output openings 15 are arranged along a front side of the base plate 14 while the plurality of the input openings 17 are arranged along a back side of the base plate 14. The bed or mat 19 is provided between the output openings 15 and input openings 17 to support the premature baby.

Inside the door 5, a first partition plate 21 is secured to the door 5 at the position away from the door 5 by the depth or width of the output opening 15. A first air path 22 is then provided between the door 5 and the first partition plate 21 to guide almost all the air emitted from the output openings 15 through the first air path 22. Inside the gradient plate 44 and top plate 43 of the hood 4, a second partition plate 23 is substantially secured to the top plate 43 through integral side walls 30. A second air path 24 is then provided between the gradient and top plates 44 and 43 and the second partition plate 23 to guide the partial air emitted from the first air path 22 through the second air path 24 to the back side of the hood 4 allowing the remaining air to disperse from two side openings between the gradient plate 44 and the second partition plate 23. Inside the back plate 42 of the hood 4, a third partition plate 25 is secured to the hood 4 at the position away from the back plate 42 by the depth or width of the input opening 17. A third air path 26 is then provided between the back plate 42 and the third partition plate 25 to guide almost the air emitted from the second air path 24 to the input openings 17.

In the second air path 24, an air vessel 28 is provided by a shoulder portion 27 in which the distance between the top plate 43 and the second partition plate 23 is partially widens. The air passing through the second air path 24 has a flow rate reduced upon entering the air vessel 28 and is resided or temporally stored in the air vessel 28.

Therefore, the incubation chamber 3 is retaining warmth by a heat source or the mass of the heated air being resided or temporally stored in the air vessel 28. Even if the cooled wind from an external air conditioner is partially applied to the top surface of hood 4, the incubation chamber 3 is not rapidly cooled by the mass of air in the air vessel 28. The side walls 30 are also provided at right and left sides to prevent the mass of air resided or temporally stored in the air vessel 28 from leaking in right and left directions thereof.

Horizontal slits or gaps 29 are provided between the output openings 15 and the first partition plate 21, the first and second partition plates 21 and 23, the second and third partition plates 23 and 25, and the third partition plate 25 and the input opening 17, respectively. The flow rate of the air eluted from these gaps 29 are slower than the flow rate of the air circulating the air paths 22, 24 and 26, and then any convention current is not generated in the incubation chamber 3. Therefore, by the air eluted from the gaps 29, the ventilation and warmth retaining are achieved without removing the body temperature and moisture components of the premature baby.

In FIG. 2, the construction for introducing the outer air is omitted as it is utilized by the known construction. When the door 5 is opened, as the air curtain is provided by the air emitted from the output openings 15, the temperature in the incubation chamber 3 is not significantly reduced even if the door 5 is opened.

Figure 3:
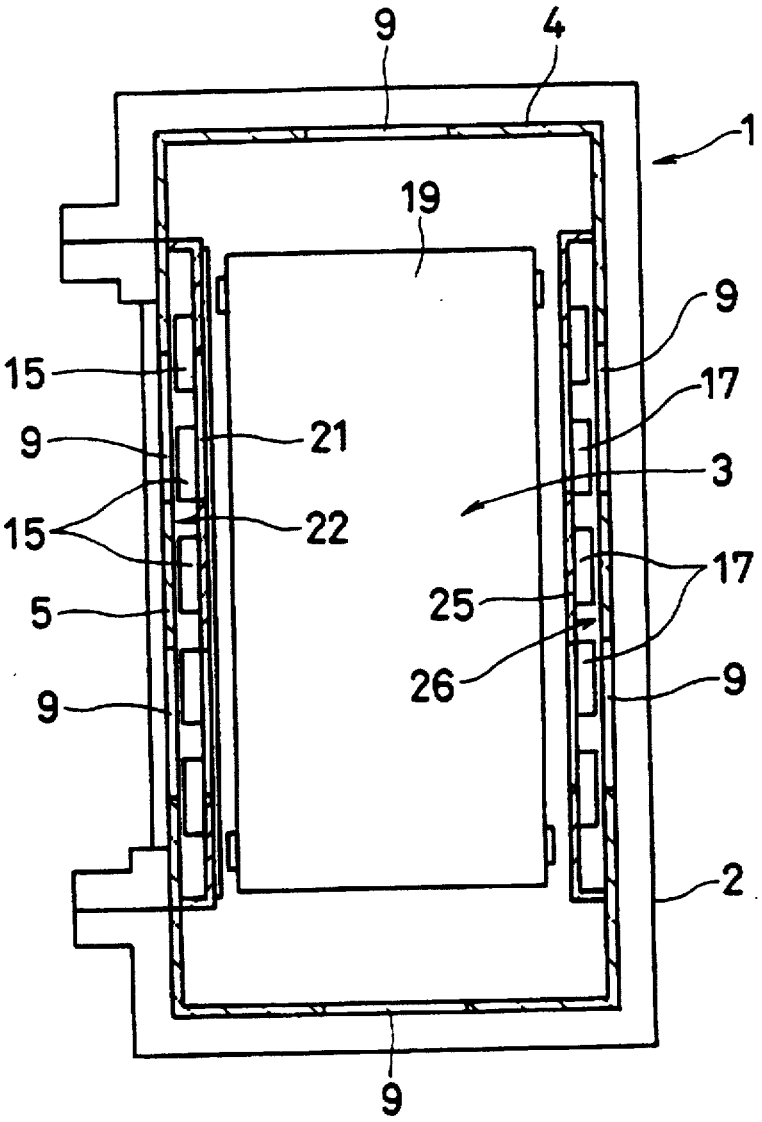
FIG. 3 shows a cross sectional view of the infant incubator taken in B—B line of FIG. 1.

FIG. 3 shows a partial cross sectional view of the infant incubator taken in B—B line of FIG. 2. In FIGS. 2 and 3, similar or same members corresponding to those of FIG. 1 are denoted same numerals, respectively.

The first partition plate 21 has a channel shape in cross section and is made of a transparent synthetic resin such as acrylic resin. The first partition plate 21 has two openings each position corresponding to that of the access ports 9. The first air path 22 composed of the first partition plate 21 and the door 5 is arranged right above the output openings 15 and conducts almost the air emitted from the output openings 15 to the first air path 22 when the door 5 is closed. In this drawing, although details of the access ports 9 are omitted, each access port 9 includes a cylindrical portion sealingly secured to an opening of the door 5 and having a depth reached to that of the first partition plate 21. Then, minor portion of the air flew through the first air path 22 may leak to the inner space of the incubation chamber 3 through the circular gaps between the cylindrical portions of the access ports 9 and the openings of the first partition plate 21.

The third partition plate 25 is also provided similar to that of the first partition plate 21. The third air path 26 composed of the third partition plate 24 and the back plate 42 is arranged right above the input openings 17 and conducts almost the air emitted from the third air path 26 to the input openings 17. Therefore, almost the air circulating through the incubation chamber 3 is sucked by the input openings 17 through respective air path 22, 24 and 26 constructed by the first partition plate 21, the second partition plate 23 (FIG. 2) and the third partition plate 25, respectively. The construction of the access ports 9 secured to the back plate 42 are similar to those of the door 5.

Figure 4:
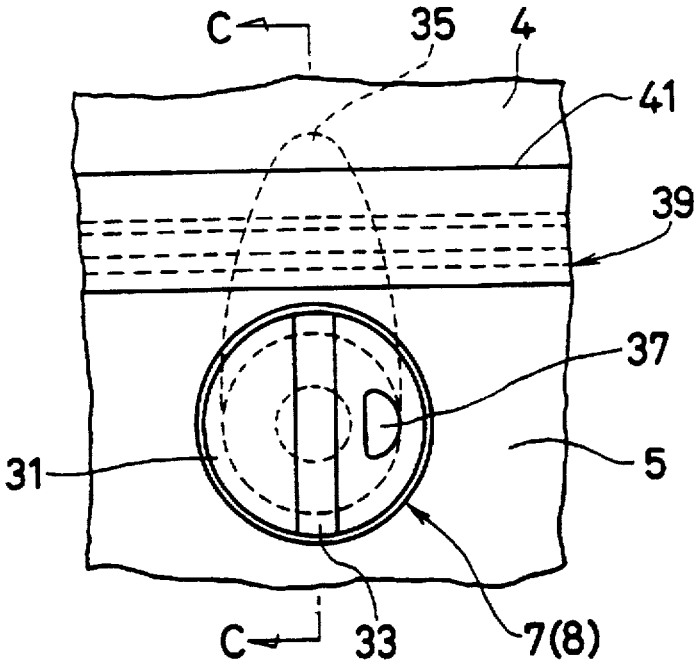
FIG. 4 shows a front view of a manual knob for locking the front door.

FIG. 4 shows a front view of a manual knob 7 or 8 for locking the front door 5. The knob 7 or 8 comprises a circular plate 31 having an axis 32 passing through an orifice of the door 5 and rotatably supported on the door 5, a diametrical projection 33 protruded from the circular plate 31 and a claw 35 secured to and carried by the axis 32 to engage the inner surface of the front plate 45 of the hood 4. The opaque or translucent circular plate 32 has a small window 37. Red and green labels for displaying lock/unlock position of the knob 7 or 8 are coated or adhered on the door 5 adjacent to the orifice so that the red or green label is viewed through the small window 37. In the lock position as shown in FIG. 4, the red label is viewed through the small window 37. When the knob 7 or 8 is pivoted by 90 degrees to unlock the door 5, the green label is viewed through the small window 37. Therefore, the lock condition of the door 5 can be recognized remote from the incubator 1.

Figure 5:
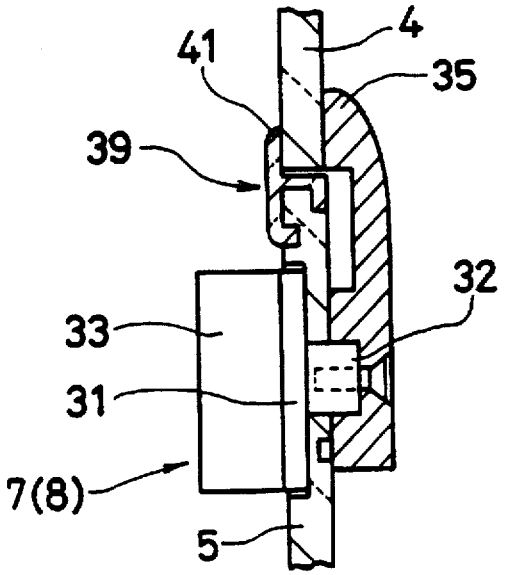
FIG. 5 shows a partial cross sectional view of the manual knob taken in C—C line of FIG. 4.

FIG. 5 shows a cross sectional view of the manual knob taken in C—C line of FIG. 4. A seal member 39 such as a transparent silicon rubber is mounted to the upper rim of the door 5. The seal member 39 has an integral tongue piece 41 contacted to the outer surface of the hood 4 upon closing the door 5. In the lock position of the door 5, the front plate 45 is sandwiched between the tongue piece 41 and the claw 41. As the seal member 39 is transparent, the operation of the knob 7 or 8 is reliably achieved as well as the color recognition through the small window.

As described the above, according to the infant incubator of the present invention, the air for the warmth retaining and ventilation in the incubation chamber is circulated through the air paths each provided along the inner surface of the hood. Then, any convention current is not generated in the incubation chamber and the ventilation and warmth retaining are achieved without removing the body temperature and moisture components of the premature baby. The flow rate of the air circulating the air paths is faster than the flow rate of the air in the incubation chamber. Then, the environmental disturbance such as temperature is absorbed by the circulating air.

The heated air is resided or temporally stored in the air vessel provided on the air path. The heat source stored in the air vessel is utilized for retaining warmth of the incubation chamber. Then, any affect of temperature change outside the incubation chamber is buffered by the heat source in the air vessel and the temperature change in the incubation chamber is limited.

Even if the cooled wind from an air conditioner is contacted to the hood, the heat exchange between the hood and the incubation chamber is effectively buffered by the mass of heat source stored in the air vessel. The air cooled in the air vessel is circulated along the air path and then heated to the predetermined level before affecting the inner space around the premature baby. Then, even if the infant incubator is disposed on the room ventilated by the air conditioner mounted on its roof or sidewall, it does not need to consider the disposed position of the infant incubator.

While the embodiments of the infant incubators according to the present invention are described as mentioned above, any modification to the shape and circuit construction thereof can be made.

For example, the heater may be used a semiconductor device such as a Peltier element as well as the ceramic heater such as a Posistor.

The foregoing disclosure and description of the invention are illustrative and explanatory thereof, various changes in the size, shape materials, components, as well as in the details of the illustrated construction and method of operation may be made without departing from the spirit of the invention.

What is claimed is:

1. An infant incubator, comprising;

a base for supporting a premature baby;

a hood mounted on the base to provide an incubation chamber isolated from the atmosphere; said hood having an inner surface:

a plurality of partition plates disposed along said inner surface of said hood to provide a plurality of air paths against said inner surface;

a fan for circulating an air through said air paths;

a heater for heating said air; and an air vessel for extending a distance between said inner surface of the hood and said partition plate causing the circulating air to reduce its velocity.

2. An infant incubator according to claim 1, wherein said air vessel is provided between a top plate of the hood and an upper partition plate.

3. An infant incubator according to claim 1, wherein at least one air gap is provided between said air paths.

4. An infant incubator according to claim 3, wherein said plurality of output or input openings are aligned with said air path.

5. The infant incubator according to claim 3 wherein a plurality of air gaps are provided between said air paths.

6. The infant incubator according to claim 5 wherein said air gaps are horizontal.

7. The infant incubator according to claim 3 wherein said air paths include an input and an output, at least one of said air gaps being located at the input and the output of said air paths.

* * * * *